US008760143B2

(12) United States Patent
Satoh

(10) Patent No.: US 8,760,143 B2
(45) Date of Patent: Jun. 24, 2014

(54) REFERENCE CURRENT GENERATION CIRCUIT

(75) Inventor: Yuji Satoh, Chiba-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 635 days.

(21) Appl. No.: 13/044,735

(22) Filed: Mar. 10, 2011

(65) Prior Publication Data

US 2012/0056609 A1 Mar. 8, 2012

(30) Foreign Application Priority Data

Sep. 7, 2010 (JP) ..... 2010-199693

(51) Int. Cl.
*G05F 3/16* (2006.01)

(52) U.S. Cl.
USPC ..... 323/315; 323/907

(58) Field of Classification Search
CPC ..... G05F 3/26; G05F 2/262
USPC ..... 323/312, 313–315, 317, 907; 327/538, 327/539, 543
See application file for complete search history.

(56) References Cited

U.S. PATENT DOCUMENTS

| | | | | |
|---|---|---|---|---|
| 6,184,745 | B1 * | 2/2001 | Kim | 327/541 |
| 7,304,466 | B1 * | 12/2007 | Kimura | 323/313 |
| 7,375,504 | B2 * | 5/2008 | Mheen et al. | 323/315 |
| 8,441,246 | B2 * | 5/2013 | Hong | 323/315 |
| 2007/0046364 | A1 | 3/2007 | Yokoo | |

FOREIGN PATENT DOCUMENTS

| | | |
|---|---|---|
| JP | 10-260746 | 9/1998 |
| JP | 11-231955 | 8/1999 |
| JP | 2007-200233 | 8/2007 |
| WO | 2008032606 | 3/2008 |

OTHER PUBLICATIONS

Japanese Office Action for Japanese Application No. 2010-199693 mailed on Feb. 6, 2013.
Song, et al.; A Precision Curvature-Compensated CMOS Bandgap Reference; IEEE Journal of Solid-State Circuits, vol. SC-18, No. 6, Dec. 1983, pp. 634-643.
Gunawan, et al.; A Curvature-Corrected Low-Voltage Bandgap Reference; IEEE Journal of Solid-State Circuits, vol. 28, No. 6, Jun. 1993, pp. 667-670.
Japanese Office Action mailed on Oct. 10, 2013 in corresponding JP Application No. 2010-199693, along with English translation.

* cited by examiner

*Primary Examiner* — Matthew Nguyen
(74) *Attorney, Agent, or Firm* — White & Case LLP

(57) ABSTRACT

One embodiment provides a reference current generation circuit. The circuit has first and second reference current generation circuits for generating first and second reference currents respectively, and a current output circuit for outputting a third reference current by adding the first and second reference currents. The first reference current generation circuit includes first and second current-voltage conversion circuits and a first current supply circuit. The first current supply circuit provides substantially equal amounts of current to the first and second current-voltage conversion circuits respectively. The second reference current generation circuit includes third to fifth current-voltage conversion circuits and a second current supply circuit. The second current supply circuit provides a current to the fourth current-voltage conversion circuit, divide and provide amounts of current substantially equal to that of the current provided to the fourth current-voltage conversion circuit, to the third and fifth current-voltage conversion circuits respectively.

16 Claims, 17 Drawing Sheets

$I1(T)=a_{10}+a_{11}T+a_{12}T^2+a_{13}T^3+\cdots$ $a_{12}<0 \quad a_{22}>0 \quad |a_{12}| \fallingdotseq |a_{22}|$ $I2(T)=a_{20}+a_{21}T+a_{22}T^2+a_{23}T^3+\cdots$ $a_{12}<0 \quad a_{22}>0 \quad |a_{12}| \fallingdotseq |a_{22}|$ $I3(T)=(a_{10}+a_{20})+(a_{11}+a_{21})T+(a_{13}+a_{23})T^3+\cdots$ $(a_{12}+a_{22}) \fallingdotseq 0$

REFERENCE CURRENT GENERATION CIRCUIT

CROSS-REFERENCE TO RELATED APPLICATION(S)

This application is based upon and claims the benefit of priority from the prior Japanese Patent Application No. 2010-199693, filed on Sep. 7, 2010, the entire contents of which are incorporated herein by reference.

FIELD

Embodiments described herein relate generally to a reference current generation circuit.

BACKGROUND

A band gap reference circuit (hereinafter referred to as "a BGR circuit") is known as a reference current generation circuit. The BGR circuit compensates temperature characteristic using a combination of a PN-junction diode having a positive temperature characteristic and a resistor having a negative temperature characteristic. Japanese Patent Application publication JP 2007-200233 discloses an example of such a BGR circuit.

The BGR circuit can compensate a first-order temperature coefficient without difficulty, but has an issue that the BGR circuit is difficult to compensate a second-order temperature coefficient.

This is because the temperature characteristic of the resistor is linear whereas the temperature characteristic of the PN-junction diode is non-linear, and because a reference current having a positive second-order temperature coefficient corresponding to a reference current having a negative second-order temperature coefficient can not easily obtained.

Accordingly, in the BGR circuit, the linearity of the reference current is bad with respect to the temperature so that a desired characteristic can not be obtained. For example, in an integrated circuit called System on Chip (SoC) in which various functions are integrated into one chip, a high degree of linearity with respect to a temperature is required for a reference current, with high-performance signal processing by the SoC.

DETAILED DESCRIPTION

Figure 1:
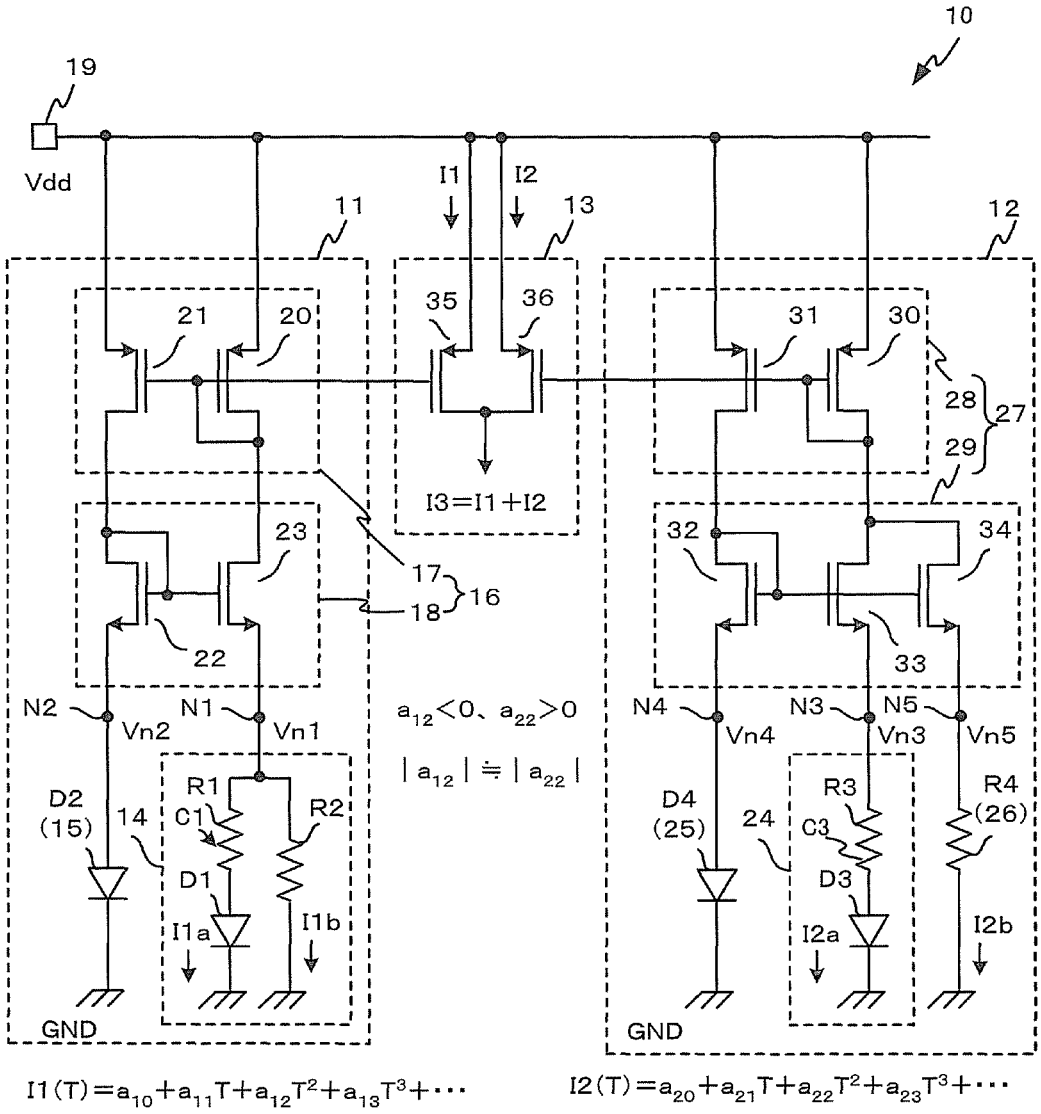
FIG. 1 is a circuit diagram illustrating a reference current generation circuit according to a first embodiment.

According to one embodiment, a reference current generation circuit is provided. The reference current generation circuit is provided with first and second reference current generation circuits for generating first and second reference currents respectively, and a current output circuit for outputting a third reference current by adding the first and second reference currents. The first reference current generation circuit includes first and second current-voltage conversion circuits and a first current supply circuit.

The first current-voltage conversion circuit is provided with a first series circuit having a first resistor and a first diode, and a second resistor connected in parallel with the first series circuit. The second current-voltage conversion circuit has a second diode. The first current supply circuit provides substantially equal amounts of current to the first and second current-voltage conversion circuits respectively.

The second reference current generation circuit includes third to fifth current-voltage conversion circuits and a second current supply circuit.

The third current-voltage conversion circuit is provided with a second series circuit having a third resistor and a third diode. The fourth current-voltage conversion circuit has a fourth diode. The fifth current-voltage conversion circuit has a fourth resistor.

The second current supply circuit provides a current to the fourth current-voltage conversion circuit, divide and provide amounts of current substantially equal to that of the current provided to the fourth current-voltage conversion circuit, to the third and fifth current-voltage conversion circuits respectively.

Hereinafter, further embodiments will be described with reference to the drawings.

In the drawings, the same reference numerals denote the same or similar portions respectively.

A first embodiment will be described with reference to FIGS. 1, 2A-2C and 3A-3C. FIG. 1 is a circuit diagram illustrating a reference current generation circuit according to the first embodiment.

As shown in FIG. 1, a reference current generation circuit 10 according to the embodiment is provided with a first reference current generation circuit 11 to generate a first reference current I1 having a negative second-order temperature coefficient $a_{12}$.

The reference current generation circuit 10 is provided with a second reference current generation circuit 12 to generate a second reference current I2 having a positive second-order temperature coefficient $a_{22}$. The absolute value of the positive second-order temperature coefficient is substantially equal to that of the negative second-order temperature coefficient of the first reference current I1.

The reference current generation circuit 10 is further provided with a current output circuit 13 to output a third reference current I3 (=11+12) obtained by adding the first reference current I1 and the second reference current I2.

The first reference current generation circuit 11 is provided with a first current-voltage conversion circuit 14, a second current-voltage conversion circuit 15 having a second diode D2, and a first current supply circuit 16.

The first current-voltage conversion circuit 14 is provided with a first series circuit C1 having a first resistor R1 and a first diode D1, and the first current-voltage conversion circuit 14 is also provided with a second resistor R2 connected in parallel with the first series circuit C1. The first current supply circuit 16 provides substantially equal amounts of current to the first and second current-voltage conversion circuits 14, 15 respectively.

In the first current supply circuit 16, first and second current mirror circuits 17, 18 are provided so as to be connected in series. The first current mirror circuit 17 includes P-channel (first conduction channel) transistors, and the second current mirror circuit 18 includes N-channel (second conduction channel) transistors, which will be described in detail. The first current mirror circuit 17 is connected to a power supply terminal 19, and the second current mirror circuit 18 is connected to the first and second current-voltage conversion circuits 14, 15.

Because the first current mirror circuit 17 having the P-channel transistors of and the second current mirror circuit 18 having the N-channel transistors are connected in series, the first current supply circuit 16 can reduce temperature drift of an input current and an output current so that the mirror ratio is highly accurate.

The first current mirror circuit 17 is provided with a P-channel insulated-gate field effect transistor (hereinafter referred to as PMOS transistor) 20 and a PMOS transistor 21 that are the P-channel transistors. The gate and the drain of the PMOS transistor 20 are connected to each other. The sources of the PMOS transistors 20, 21 are connected to the power supply terminal 19, so that a power supply voltage Vdd is given to the PMOS transistors 20, 21. The gate of the PMOS transistor 21 is connected to the gate of the PMOS transistor 20. Currents are outputted from the drains of the PMOS transistors 20, 21.

The second current mirror circuit 18 is provided with an NMOS transistor 22 and an NMOS transistor 23 that are the N-channel transistors. The drain of the PMOS transistor 20 is connected to the drain of the NMOS transistor 23. The drain of the PMOS transistor 21 is connected to the drain of the NMOS transistor 22.

The gate and the drain of the NMOS transistor 22 are connected to each other. The currents are input into the drains of the NMOS transistors 22, 23, respectively. The gate of the NMOS transistor 23 is connected to the gate of the NMOS transistor 22. Currents are outputted from the sources of the NMOS transistors 22, 23, respectively.

The current mirror ratio of the first current mirror circuit 17 is set at 1 (one). The current mirror ratio of the second current mirror circuit 18 is also set at 1 (one).

The first current-voltage conversion circuit 14 is connected between the source of the NMOS transistor 23 and a terminal of a reference potential GND, i.e., a ground potential. The second current-voltage conversion circuit 15 is connected between the source of the NMOS transistor 22 and the terminal of the reference potential GND.

The second reference current generation circuit 12 is provided with a third current-voltage conversion circuit 24, a fourth current-voltage conversion circuit 25 having a fourth diode D4, a fifth current-voltage conversion circuit 26 having a fourth resistor R4, and a second current supply circuit 27.

The third current-voltage conversion circuit 24 is provided with a second series circuit C3 having a third resistor R3 and a third diode D3. The second current supply circuit 27 divides a current equal to a current provided to the fourth current-voltage conversion circuit 25 with a constant ratio (k:1-k), and provides the divided currents to the third and fifth current-voltage conversion circuits 24, 26.

The second current supply circuit 27 has a series circuit including a third current mirror circuit 28 having P-channel transistors and a fourth current mirror circuit 29 of a multiple output type having N-channel transistors, which will be described in detail below. The third current mirror circuit 28 which is provided in the second current supply circuit 27 is connected to the power supply terminal 19. The fourth current mirror circuit 29 provided in the second current supply circuit 27 is connected to the third to fifth current-voltage conversion circuits 24 to 26.

Because, in the second current supply circuit 27, the third current mirror circuit 28 having the P-channel transistors and the fourth current mirror circuit 29 having the N-channel transistors are connected in series, the second current supply circuit 27 can reduce temperature drift of an input current and an output current so that the mirror ratio is highly accurate.

The third current mirror circuit 28 is provided with PMOS transistors 30, 31. The gate and the drain of the PMOS transistor 30 are connected to each other. The sources of the PMOS transistors 30, 31 are connected to the power supply terminal 19, so that a power supply voltage Vdd is given to the PMOS transistors 30, 31. The gate of the PMOS transistor 31 is connected to the gate of the PMOS transistor 30. Currents are output from the drains of the PMOS transistors 30, 31.

The fourth current mirror circuit 29 is provided with NMOS transistors 32 to 34. The drain of the PMOS transistor 30 is connected to the drains of the NMOS transistors 33, 34. The drain of the PMOS transistor 31 is connected to the drain of the NMOS transistor 32.

The gate and the drain of the NMOS transistor 32 are connected to each other. The gate of the NMOS transistor 33 is connected to the gate of the NMOS transistor 32. A portion k of the output current output from the drain of the PMOS transistor 30 flows through the NMOS transistor 33. The gate of the NMOS transistor 34 is connected to the gate of the NMOS transistor 32. The remaining portion (1-k) of the output current output from the drain of the PMOS transistor 30 flows through the NMOS transistor 34.

The current mirror ratio of the third current mirror circuit 28 is set at 1 (one). In the fourth current mirror circuit 29, the current mirror ratio of the current flowing through the NMOS transistor 33 is set at k. The current mirror ratio flowing through the NMOS transistor 34 is set at (1-k).

The third current-voltage conversion circuit 24 is connected between the source of the NMOS transistor 33 and a terminal of the reference potential GND. The fourth current-voltage conversion circuit 25 is connected between the source of the NMOS transistor 32 and a terminal of the reference potential GND. The fifth current-voltage conversion circuit 26 is connected between the source of the NMOS transistor 34 and a terminal of the reference potential GND.

The forward voltage values and the temperature dependencies of the forward voltages of the first to fourth diodes D1 to D4 are as follows. For example, the forward voltage values and the temperature dependencies of the diode D1 and the diode D3 are substantially the same. The forward voltage values and the temperature dependencies of the diode D2 and the diode D4 are substantially the same.

The resistance values and the temperature dependencies of the resistances of the third and fourth resistors R1, R3 are substantially the same, for example.

The current output circuit 13 is provided with a parallel circuit having PMOS transistors 35, 36. The sources of the PMOS transistors 35, 36 are connected to the power supply terminal 19. As described below, the PMOS transistor 35 is additionally connected to the first current mirror circuit 17 so as to form a current mirror circuit of a multiple output type. As described below, the PMOS transistor 36 is additionally connected to the third current mirror circuit 28 so as to form a current mirror circuit of a multiple output type.

More specifically, the gate of the PMOS transistor 35 is connected to the gate of the MOS transistor 20. The gate of the PMOS transistor 36 is connected to the gate of the PMOS transistor 30. Each of the current mirror ratios of the currents flowing through the PMOS transistors 35, 36 is set at 1 (one).

As described below, in the reference current generation circuit 10, a negative second-order temperature coefficient is generated according to the temperature characteristic of a current I1*b* of the second resistor R2, in such a manner as to depend on a difference between the non-linear values of the temperature characteristics of the first and second diodes D1, D2. As described below, a positive second-order temperature coefficient is generated according to a voltage Vn5 generated in the fourth resistor R4 in such a manner as to depend on a difference between the non-linear values of the temperature characteristics of the third and fourth diodes D3, D4.

Figure 2A:
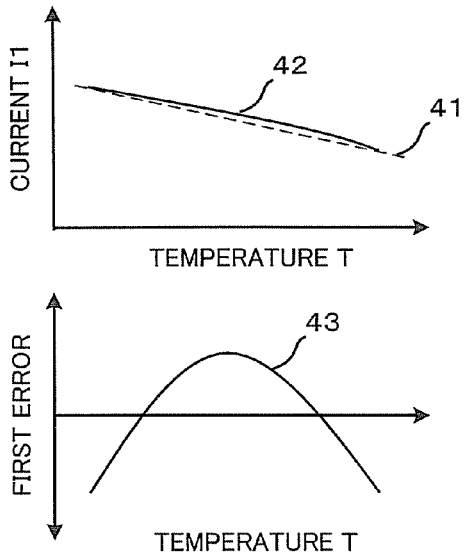
FIGS. 2A to 2C are views to explain temperature characteristics of first to third reference currents according to the first embodiment, respectively.
Figure 2B:
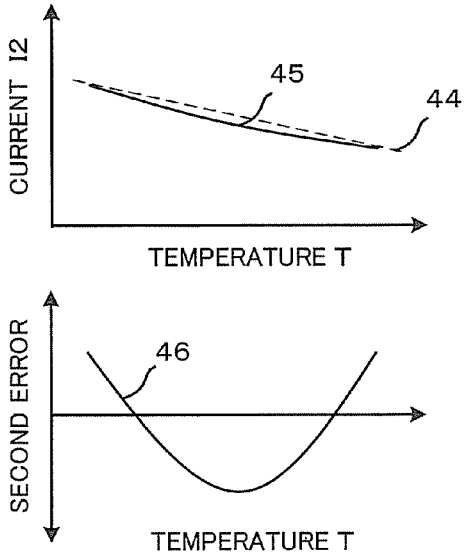
Figure 2C:
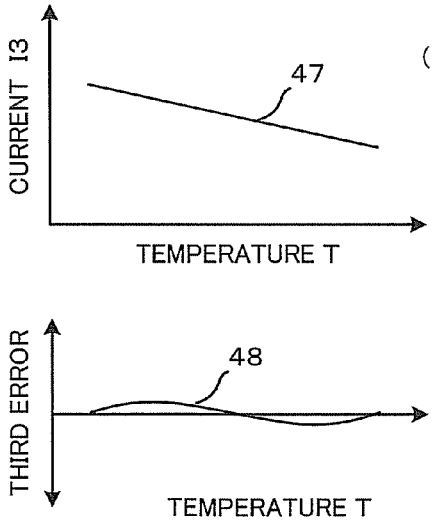

FIGS. 2A to 2C are views to explain temperature characteristics of the first to third reference currents I1 to I3 of FIG. 1. The temperature characteristics of the first to third reference currents I1 to I3 are represented by the following equations of polynomial approximations using a temperature T as a variable.

$$I1(T)=a10+a_{11}T+a_{12}T^2+a_{14}T^3+ \quad (1)$$

$$I2(T)=a_{20}+a_{21}T+a_{22}T^2+a_{23}T^3+ \quad (2)$$

$$I3(T)=(a_{10}+a_{20})+(a_{11}+a_{21})T+(a_{13}+a_{23})T^3+ \quad (3)$$

Each of the above temperature coefficients $a_{xy}$ (X, Y=zero or positive integer) is not particularly limited to either positive or negative value except for constant terms.

As shown in FIG. 2A, the first reference current I1 has a negative temperature characteristic. As will be described in detail below, the second temperature coefficient of the first reference current I1 is negative. Accordingly, when the temperature T rises, the first reference current I1 decreases according to a curve 42 which is projected slightly upward above a straight line 41.

A first error represented by the curve 43 represents a difference between the straight line 41 and the curve 42. The linearity is bad between the temperature T and the first reference current I1, and this causes a second error represented by a curve 43.

On the other hand, as shown in FIG. 2B, the second reference current I2 also has a negative temperature characteristic. As will be described in detail below, the second temperature coefficient of the second reference current I2 is positive. Accordingly, when the temperature T rises, the second reference current I2 decreases according to a curve 45 which is projected slightly downward below a straight line 44.

Accordingly, the linearity is bad between the temperature T and the second reference current I2, and this causes a second error represented by a curve 46. The second error represented by the curve 46 represents a difference between the straight line 44 and the curve 45.

As shown in FIG. 2C, the third reference current I3 obtained by adding the first reference current I1 and the second reference current I2 has a negative temperature characteristic. The second-order temperature coefficients of the first reference current I1 and the second reference current I2 cancel each other. Accordingly, as the temperature T rises, the third reference current I3 decreases according to a substantially straight line 47.

Accordingly, the linearity can be ensured between the temperature T and the third reference current I3. However, a small third error represented by an S-shaped curve 48 occurs. This is because the third and higher order temperature coefficients are not cancelled.

With reference back to FIG. 1, operation of the reference current generation circuit 10 will be described in detail. The current-input nodes of the first to fifth current-voltage conversion circuits 14, 15, and 24 to 26 are shown as nodes N1 to N5, respectively. The potentials of the nodes N1 to N5 are shown as Vn1 to Vn5, respectively.

When the second resistor R2 is sufficiently large in the first reference current generation circuit 11, the potential Vn1 is determined by the first series circuit C1 including the first resistor R1 and the first diode D1, and the potential Vn2 is determined by the second diode D2. The potential Vn1 of the node N1 is substantially equal to the potential Vn2 of the node N2 (Vn1=Vn2), constantly.

The following equations are satisfied, assuming that Vd1 and Vd2 are the voltages of the first and second diodes D1, D2, respectively, $$Vn1=I1aR1+Vd1 \quad (4)$$

$$Vn2=Vd2 \quad (5)$$

The currents I1*a*, I1*b* are represented by the following equations based on the above equations.

$$I1a=(Vd2-Vd1)/R1 \quad (6)$$

$$I1b=Vd2/R2 \quad (7)$$

Accordingly, the first reference current I1 is represented by the following equation.

$$I1=I1a+I1b=(Vd2-Vd1)/R1+Vd2/R2 \quad (8)$$

For example, when R1 is sufficiently smaller than R1 (R2>>R1), the following equation is obtained.

$$I1=I1a=(Vd2-Vd1)/R1 \quad (9)$$

The first reference current I1 has the temperature coefficient depending on non-linearity of the voltages Vd1, Vd2 of the first and second diodes D1, D2.

As the temperature rises, the barriers of the PN-junctions of the first and second diodes D1, D2 decreases. Accordingly, both of the potentials Vn1, Vn2 of the nodes N1, N2 decrease. When the potential Vn1 decreases, the current I1*b* flowing through the second resistor R2 decreases according to Ohm's law.

Similarly, in the second reference current generation circuit 12, the potential Vn3 of the node N3 is determined by the second series circuit C3 including the third diode D3 and the third resistor R3, and the potential Vn4 of the node N4 is determined by a fourth diode D4. Similarly to the potential Vn1 of the node N1 and the potential Vn2 of the node N2, the potential Vn3 of the node N3 is substantially to the potential Vn4 of the node N4 (Vn3=Vn4), constantly.

The following equations are satisfied, assuming that Vd3 and Vd4*n* are the voltages of the third and fourth diodes D3, D4, respectively.

$$Vn3=I2aR3+Vd3 \tag{10}$$

$$Vn4=Vd4 \tag{11}$$

The currents I2*a*, I2*b* are represented by the following equations.

$$I2a=(Vd4-Vd3)/R3 \tag{12}$$

$$I2b=((Vd4-Vd3)/R3)(1-k)/k \tag{13}$$

Accordingly, the second reference current I2 is represented by the following equation.

$$I2=I2a+I2b=(Vd4-Vd3)/(kR3) \tag{14}$$

Further, the node N5 has the potential Vn5 (=I2*b*R4). This can be represented by the following equation.

$$Vn5=((Vd4-Vd3)/R3)R4(1-k)/k \tag{15}$$

The second reference current I2 has a temperature coefficient depending on non-linearity of the voltages Vd3, Vd4 of the third and fourth diodes D3, D4.

As the temperature rises, the barriers of the PN-junctions of the third and fourth diodes D3, D4 decreases. Accordingly, the current I2*a* flowing through the NMOS transistor 33 increases. The current I2*a* is determined by the current mirror ratio k of the NMOS transistor 33 of the fourth current mirror circuit 29.

Similarly, the current I2*b* flowing through the NMOS transistor 34 also increases. The current I2*b* is determined by the current mirror ratio (1-k) of the NMOS transistor 34 of the fourth current mirror circuit 29. As a result, the potential Vn5 of the node N5 increases.

As the potential Vn5 of the node N5 increases, a drain source voltage Vds and a gate-source voltage Vgs of the NMOS transistor 34 decrease. Accordingly, the drain current I2*b* of the NMOS transistor 34 decreases.

In general, the drain current id in a saturation region of an MOS transistor is represented by the following equation. Vth denotes a threshold value of the MOS transistor. X denotes a channel length modulation coefficient.

$$Id\propto(Vgs-Vth)^2(1+\lambda Vds) \tag{16}$$

As can be seen from the above equation, when the drain-source voltage Vds and the gate-source voltage Vgs decrease, the drain current Id decreases.

Thus, the potential Vn5 of the node N5 is defined by a sum of a first effect, i.e., increase of the potential Vn5, and a second effect, i.e., increase of the potential Vn5. According to the first effect, as the current I2*a* increases in the node N3, the current I2*b* and the potential Vn5 increase. According to the second effect, as the potential Vn5 increases, the current I2*b* and the potential Vn5 decrease due to operational characteristics of the NMOS transistor 34. The temperature characteristics of the potential Vn5 can be reversed by balancing the first and the second effect.

When the temperature changes, the first reference current I1 has a negative second-order temperature coefficient, the second reference current I2 shows a positive second-order temperature coefficient due to a difference between the behavior of the potential Vn1 at the node N1 caused by the current I1*b* and the behavior of the potential Vn5 at the node N5 caused by the current I2*b*.

Figure 3A:
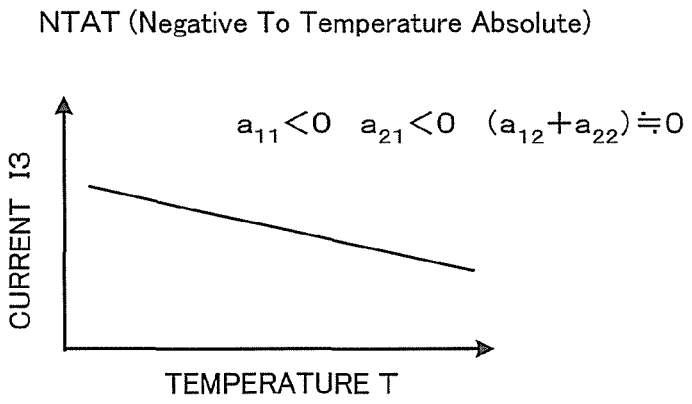
FIGS. 3A to 3C are views to show temperature characteristic modes of a third reference current according to the first embodiment.
Figure 3B:
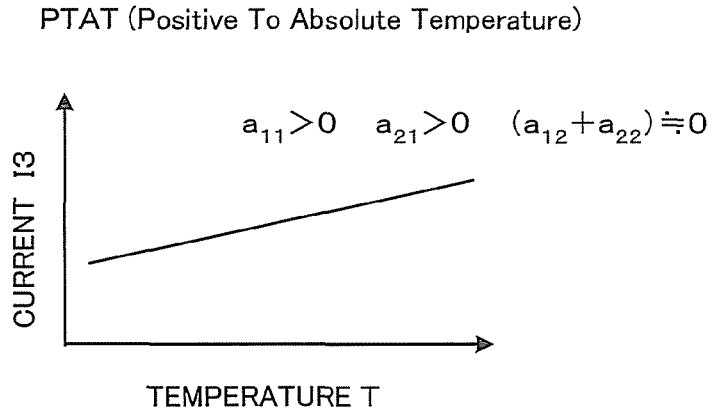
Figure 3C:
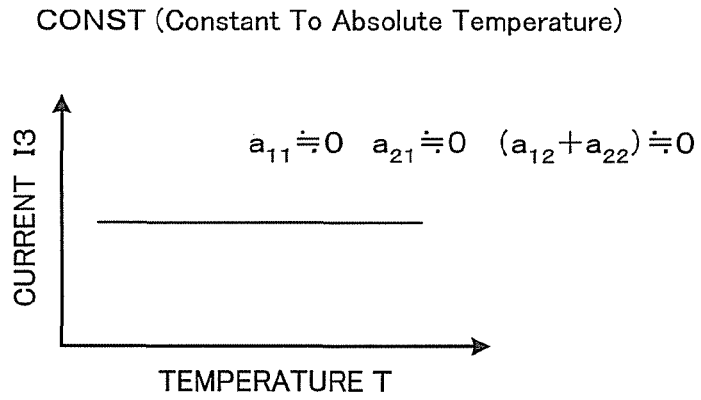

FIGS. 3A to 3C are views to show temperature characteristic modes of the third reference currents I3. As to the third reference current I3, the second-order temperature coefficient is compensated, and the linearity is ensured with respect to the temperature T. However, the first-order temperature coefficient may be any value. Accordingly, the following three temperature characteristic modes may occur.

FIG. 3A illustrates a case where the third reference current I3 has a negative temperature characteristic. FIG. 3B illustrates a case where the third reference current I3 has a positive temperature characteristic. FIG. 3C illustrates a case where the third reference current I3 has a constant temperature characteristic.

The temperature characteristic modes are switched by adjusting the ratio between the currents I1*a* and I1*b* in the first reference current generation circuit 11. The current ha depends on the positive temperature coefficient determined by the first diode D1. The current I1*b* depends on the negative temperature coefficient determined by the second resistor R2. Further, the temperature characteristic modes are switched, by adjusting the resistances of the third and fourth resistor R3, R4 provided in the second reference current generation circuit 12 so as to control the mounts of the currents I2*a*, I2*b*.

When the first-order temperature coefficients $a_{11}$, $a_{21}$ of the first and second currents I1, I2 are adjusted to negative values, the third reference current I3 having a negative first-order temperature coefficient as illustrated in FIG. 3A is obtained. This temperature characteristic mode is referred to as Negative To Absolute Temperature (NTAT).

When the first-order temperature coefficients $a_{11}$, $a_{21}$ are adjusted to positive values, the third reference current I3 having a positive first-order temperature coefficient as illustrated in FIG. 3B is obtained. This temperature characteristic mode is referred to as Positive To Absolute Temperature (PTAT).

When the first-order temperature coefficients $a_{11}$, $a_{21}$ are adjusted to substantially zero, the third reference current I3 having a first-order temperature coefficient of zero as illustrated in FIG. 3C is obtained. This temperature characteristic mode is referred to as Constant To Absolute Temperature (CONST).

Figure 4A:
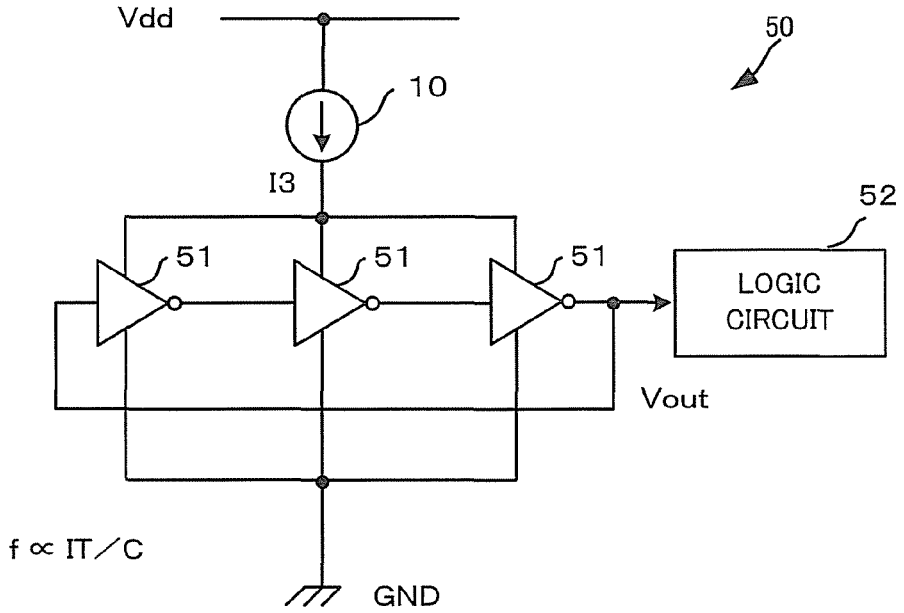
FIG. 4A illustrates an example of an oscillation circuit using the reference current generation circuit according to the first embodiment.
Figure 4B:
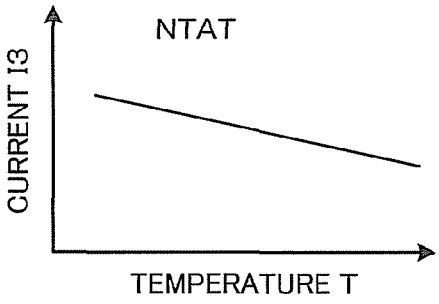
FIGS. 4B and 4C show reference current and oscillation frequency characteristics of the oscillation circuit with respect to temperature.
Figure 4C:
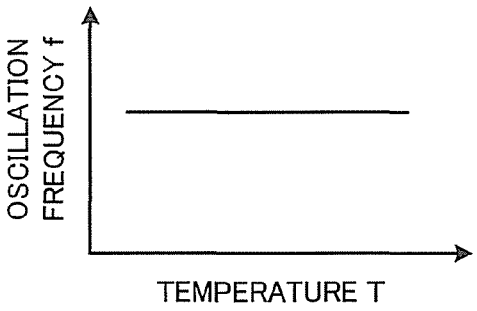

FIG. 4A illustrates an example of an oscillation circuit using the reference current generation circuit 10. FIGS. 4B and 4C show reference current and oscillation frequency characteristics of the oscillation circuit with respect to temperature, respectively.

An oscillation circuit 50 shown in FIG. 4A is a ring oscillation circuit having three inverters 51. The output Vout of the oscillation circuit 50 is provided to a logic circuit 52, for example. The inverters 51 are connected in a ring form. The third reference current I3 having the NTAT temperature characteristic mode is provided from the reference current generation circuit 10 to each of the inverters 51.

In the oscillation circuit 50, the oscillation frequency f is determined by the number of stages N and a propagation delay time τd of the inverters 51 as shown in the following equation.

$$g \propto 1/N\tau d$$

The propagation delay time τd is proportional to a load capacity C of the inverters 51, and is proportional to an operational current I and an operational temperature T. Accordingly, the oscillation frequency f is represented as follows.

$$f \propto IT/C$$

Accordingly, the change of the oscillation frequency depending on the temperature T is cancelled by the third reference current I3 having the NTAT temperature characteristic mode. As a result, the ring oscillation circuit 50 may have characteristics of a small change with temperature change.

Figure 5:
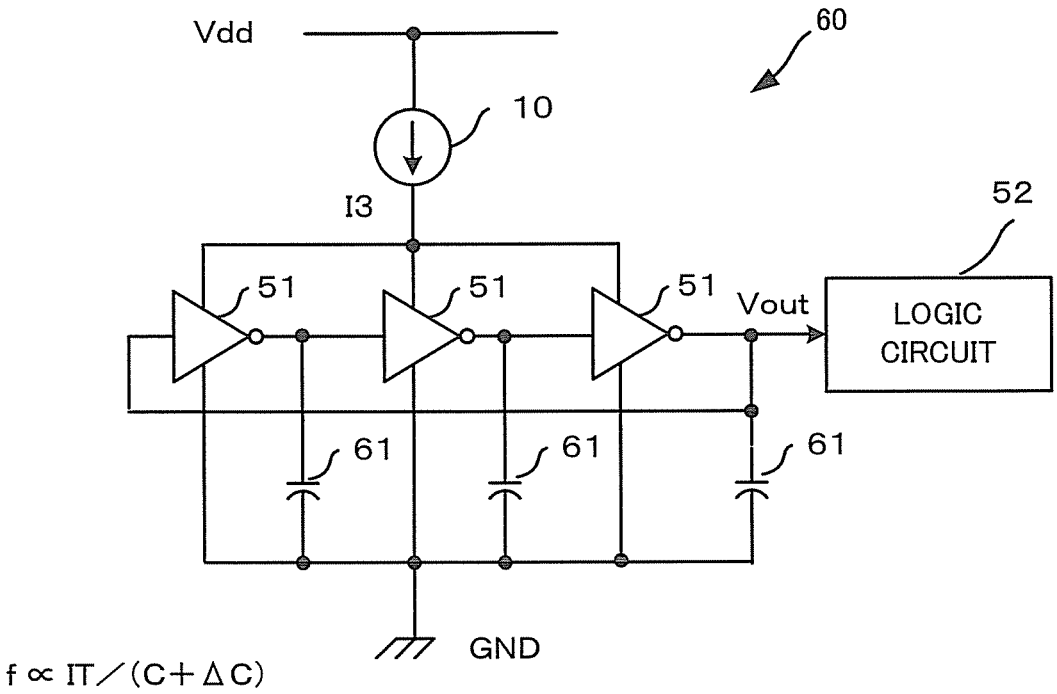
FIG. 5 illustrates another example of an oscillation circuit using the reference current generation circuit according to the first embodiment.

FIG. 5 is a block diagram illustrating another example of an oscillation circuit using the reference current generation circuit 10. In FIG. 5, an oscillation circuit 60 is a ring oscillation circuit which is provided with capacitors 61, inverters, a logic circuit 52, and the reference current generation circuit 10.

Each of the capacitors 61 is connected to the output terminal of each of the inverters 51. Under existence of each of the capacitors 61, a capacitance ΔC is added to a load capacitance C, which changes the oscillation frequency.

The change of the oscillation frequency caused by the temperature T is compensated by the third reference current I3 having the NTAT temperature characteristic mode. Accordingly, the frequency can be stably tuned by the capacitance ΔC.

Figure 6:
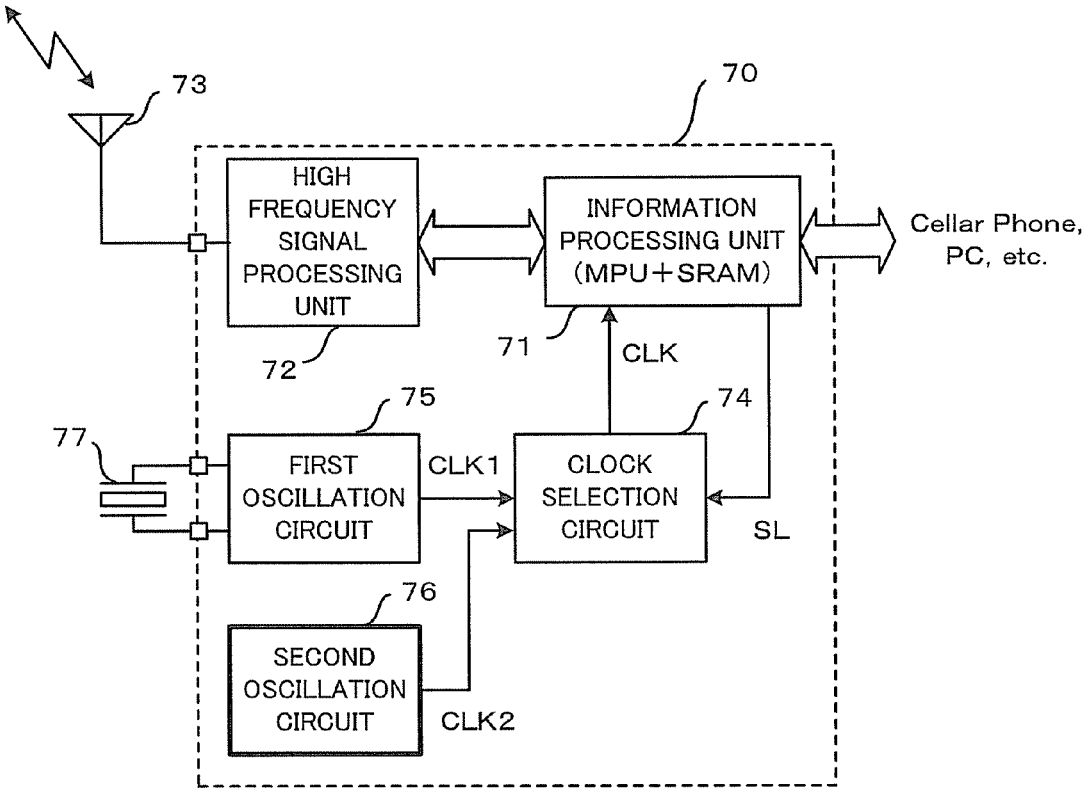
FIG. 6 is a block diagram illustrating an example of an integrated circuit using an oscillation circuit.

FIG. 6 is a block diagram illustrating an integrated circuit using the oscillation circuit. As illustrated in FIG. 6, an integrated circuit 70 is, for example, a communication module for wireless communication with a low power consumption.

In the integrated circuit 70, the information processing unit 71 has a microprocessor and a memory, for example. The information processing unit 71 exchanges information with an information processing apparatus such as a cellular phone or a personal computer of outside (not shown), and performs processing of the information.

The integrated circuit 70 is provided with a high frequency signal processing unit 72 to modulate information processed by the information processing unit 71 with a high frequency signal, and to transmit the modulated information to the outside via an antenna 73 attached externally. Further, the high frequency processing unit 72 demodulates a high frequency signal received from the outside, and transmits the high frequency signal to the information processing unit 71.

The information processing unit 71 transmits a selection signal SL to a clock selection circuit 74. The clock selection circuit 74 selects one of a clock signal CLK1 from a first oscillation circuit 75 and a clock signal CLK2 from a second oscillation circuit 76. The information processing unit 71 performs operation using the selected clock signal as a clock signal CLK.

The first oscillation circuit 75 is an oscillator which is connected with a crystal vibrator 77 provided externally. The clock signal CLK1 provided from the first oscillator 75 can be highly accurate. The second oscillation circuit 76 is an oscillator which is provided with the ring oscillator 50 shown in FIG. 4A or the ring oscillator 60 shown in FIG. 5 respectively described above.

The first oscillator 75 consumes much power. On the other hand, the clock signal CLK2 provided from the second oscillator 76 is stable with respect to temperature change, and consumes less power than the first oscillator 75.

When the information processing unit 71 performs high speed information processing, the information processing unit 71 may select the clock signal CLK1. When the information processing unit 71 is in a waiting state for processing, the information processing unit 71 may select the clock signal CLK2. Thus, the integrated circuit 70 has sufficient signal processing performance with low power consumption.

As described above, in the reference current generation circuit 10 according to the embodiment, the first reference current generation circuit 11 generates the first reference current I1 having the negative second-order temperature coefficient. The second reference current generation circuit 12 generates the second reference current I2 having the positive second-order temperature coefficient. The absolute value of the positive second-order temperature coefficient is substantially equal to that of the negative second-order temperature coefficient of the first reference current generation circuit 11. The current output circuit 13 outputs the third reference current I3 obtained by adding the first reference current I1 and the second reference current I2.

As a result, the second-order temperature coefficients of the first and second reference currents I1, I2 are compensated so that the third reference current I3 may indicate a sufficient linearity with respect toe temperature change.

The reference current generation circuit 10 which is capable of compensating the second-order temperature coefficient is described above. Based on the same idea, it is possible to provide a reference current generation circuit capable of compensating a third or higher order temperature coefficient. In this case, the higher the order of the temperature coefficient is, the more likely the temperature coefficient is affected by disturbance.

Figure 7:
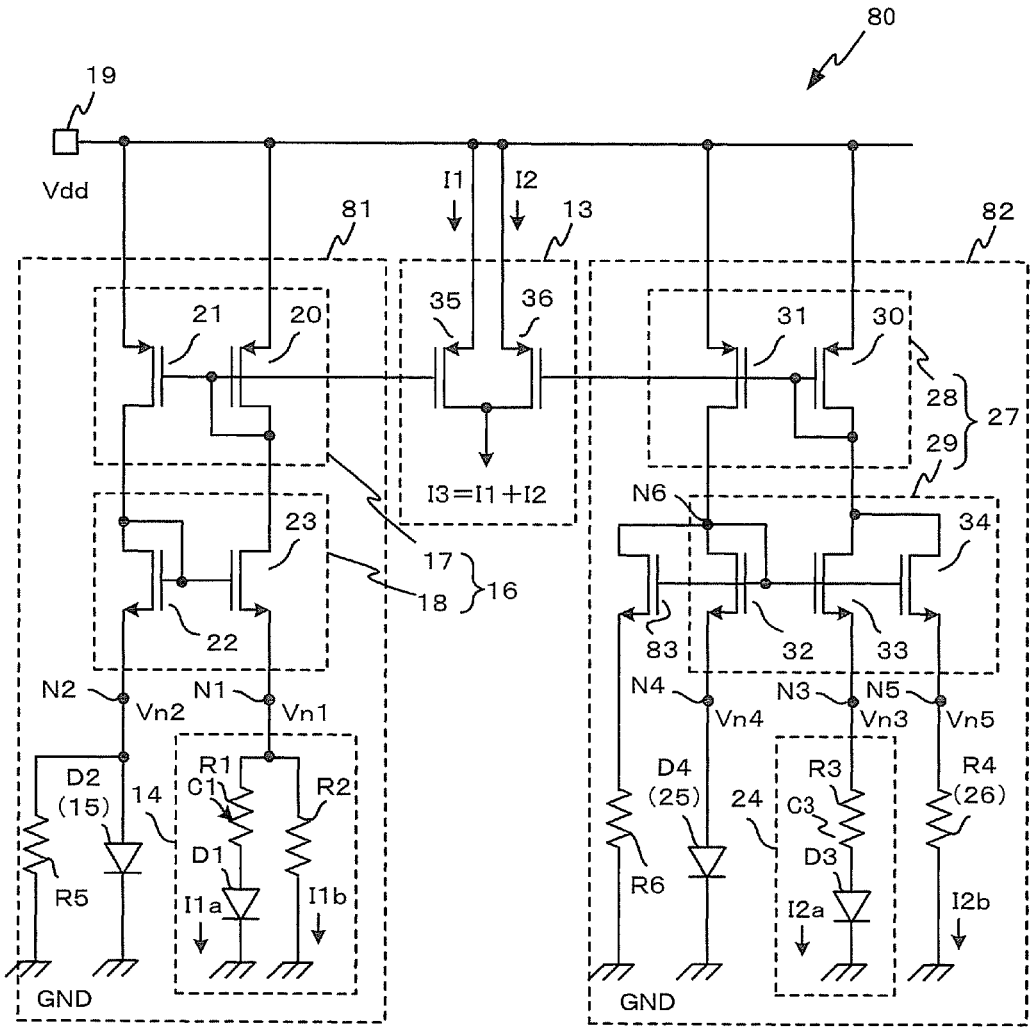
FIG. 7 is a circuit diagram illustrating a reference current generation circuit according to a second embodiment.

A reference current generation circuit according to the second embodiment will be described with reference to FIG. 7. FIG. 7 is a circuit diagram illustrating the reference current generation circuit of the second embodiment.

In FIG. 7A, a reference current generation circuit 80 of the embodiment is provided with not only the circuit shown in FIG. 1 but also a fifth resistor R5 and a series circuit having a sixth resistor and an NMOS transistor 83. The drain and gate of the NMOS transistor 83 are connected to each other.

The fifth resistor R5 is connected in parallel with the second diode D2. The series circuit of the sixth resistor R6 and the NMOS transistor 83 is connected to a current input node N6 of the fourth current mirror circuit 29. The drain of the NMOS transistor 83 is connected to the drain of the PMOS transistor 31.

The fifth resistor R5 is provided so that the currents flowing through the first diode D1 and the second diode D2 may be matched. The sixth resistor R6 is provided so that the currents flowing through the third diode D3 and the fourth diode D4 may be matched. Thus, the errors of the first, second and third reference currents I1, I2 and I3 which are caused by temperature change can be reduced.

Figure 8A:
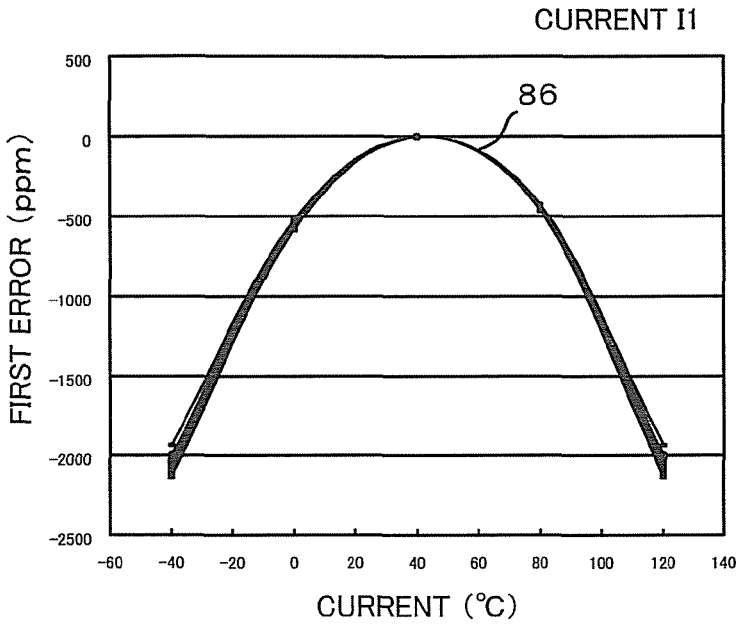
FIGS. 8A, 8B, and 9 illustrate simulation results of temperature characteristics of the reference current according to the second embodiment.
Figure 8B:
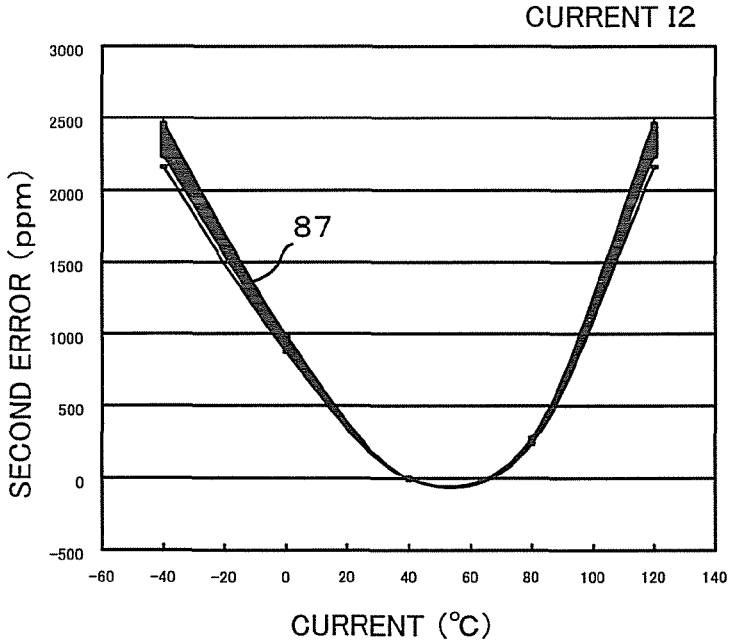
Figure 9:
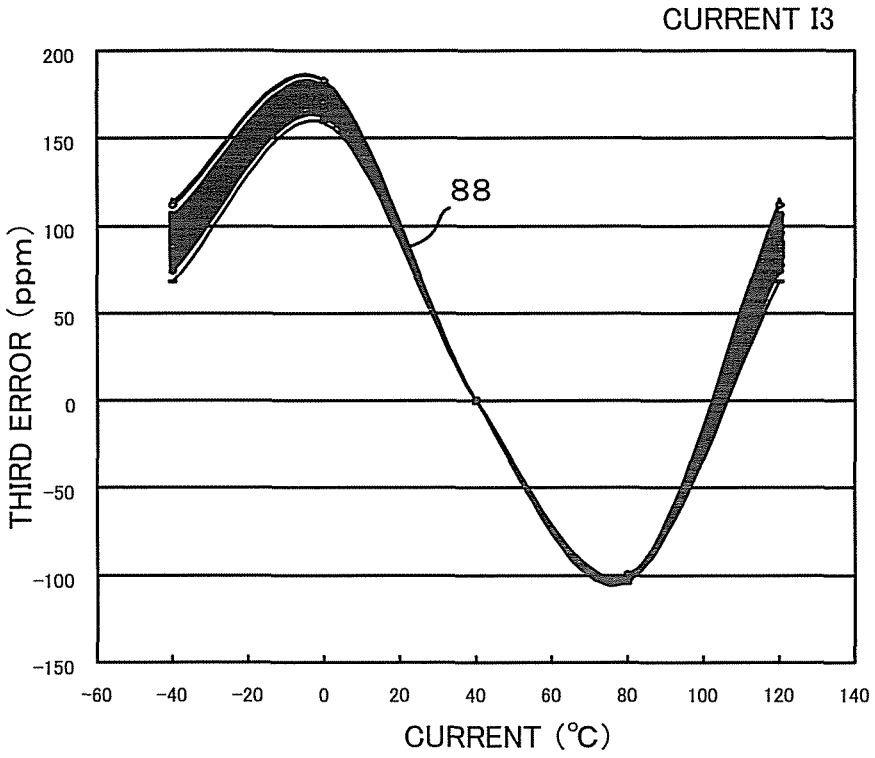

Simulation results of temperature dependencies of the first to third errors of the first to third reference currents I1 to I3 will be described with reference to FIGS. 8A, 8B, and 9. FIG. 8A, 8B illustrate the first and second errors respectively. FIG. 9 illustrates the third error. The simulation is performed using Monte Carlo method while parameters such as sizes or threshold values of the MOS transistors provided in the second embodiment are changed. As described above, the first to third errors represent differences between second or higher order temperature characteristics of the first to third reference currents I1 to I3, except for the temperature characteristic up to the first order, and ideal linear temperature characteristics, respectively.

As illustrated in FIG. 8A, the first error is represented by a curve 86, which is projected upward at a temperature T between −40° C. and 120° C., and has a value from about −2000 ppm to about 0 ppm.

On the other hand, as illustrated FIG. 8B, the second error is represented by a curve 87, which is projected downward at a temperature T between −40° C. and 120° C., and has a value from about −2300 ppm to about −50 ppm.

As a result, as illustrated FIG. 9, the third error is represented by a curve 88, which indicates an S-shape between −40° C. and 120° C., and has a value from about −50 ppm to about 300 ppm. From the above simulation data, the amount of the third error has been found to decrease by approximately one order from those of the first and second errors.

As described above, in the reference current generation circuit 80 according to the embodiment, the fifth resistor R5 is connected in parallel with the second diode D2. Further, the series circuit having the sixth resistor R6 and the NMOS transistor 83 is connected to the current input node N6 of the fourth current mirror circuit 29. The drain and gate of the NMOS transistor 83 are connected to each other.

This structure shows an advantage of reducing the temperature errors of the first to third reference currents I1 to I3 as well as the advantages of the first embodiment.

Figure 10:
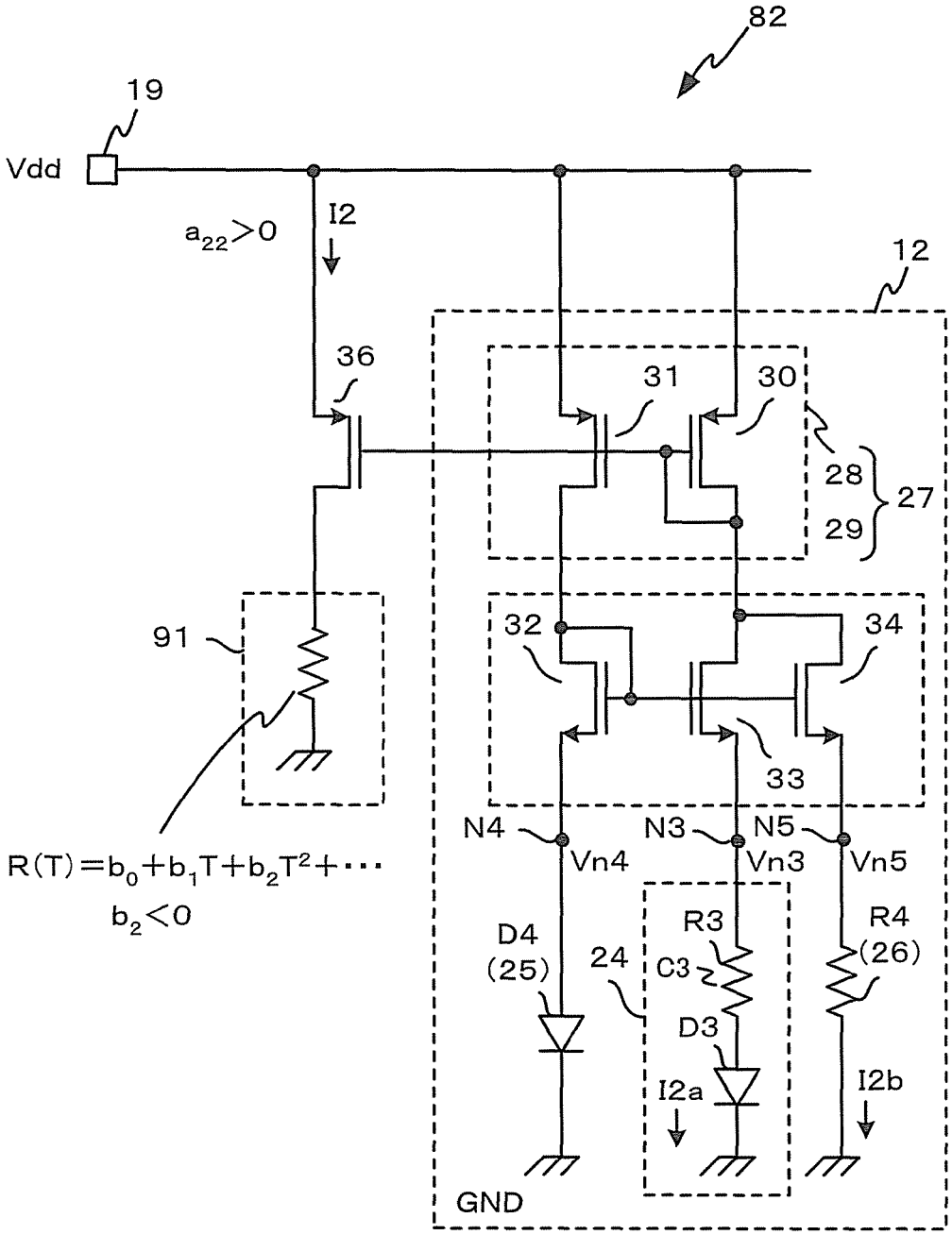
FIG. 10 is a circuit diagram illustrating a reference current generation circuit according to a third embodiment.

A reference current generation circuit according to the third embodiment will be described with reference to FIG. 10. FIG. 10 is a circuit diagram illustrating the reference current generation circuit according to the third embodiment.

As illustrated in FIG. 10, a reference current generation circuit 90 according to the embodiment is provided with a second reference current generation circuit 12, which is similar to the circuit of FIG. 1. Further, the reference current generation circuit 90 is provided with a PMOS transistor 36 and a load 91 having a negative second-order temperature coefficient, such as a resistor of a diffused layer or a polysilicon resistor. The source of the PMOS transistor 36 is connected to a power supply terminal 19. The gate of the PMOS transistor 36 is connected to the gates of PMOS transistors 30, 31 of the reference current generation circuit 12. The drain of the PMOS transistor 36 is connected to one end of the load 91. The PMOS transistor 36 is controlled by the second reference current generation circuit 12. The other end of the load 91 is grounded. A second reference current I2 is provided to the load 91. The second reference current I2 flows through the PMOS transistor 36. The second reference current I2 has a positive second-order temperature coefficient.

Accordingly, the reference current generation circuit 90 can ensure linearity of the current flowing through the load 91 having the negative second-order temperature coefficient with respect to temperature.

The reference current generation circuit 90 according to the embodiment provides the second reference current I2 having the positive second-order temperature coefficient to the load 91 having the second-order temperature coefficient, so that the linearity of the load current with respect to the temperature is ensured.

Figure 11:
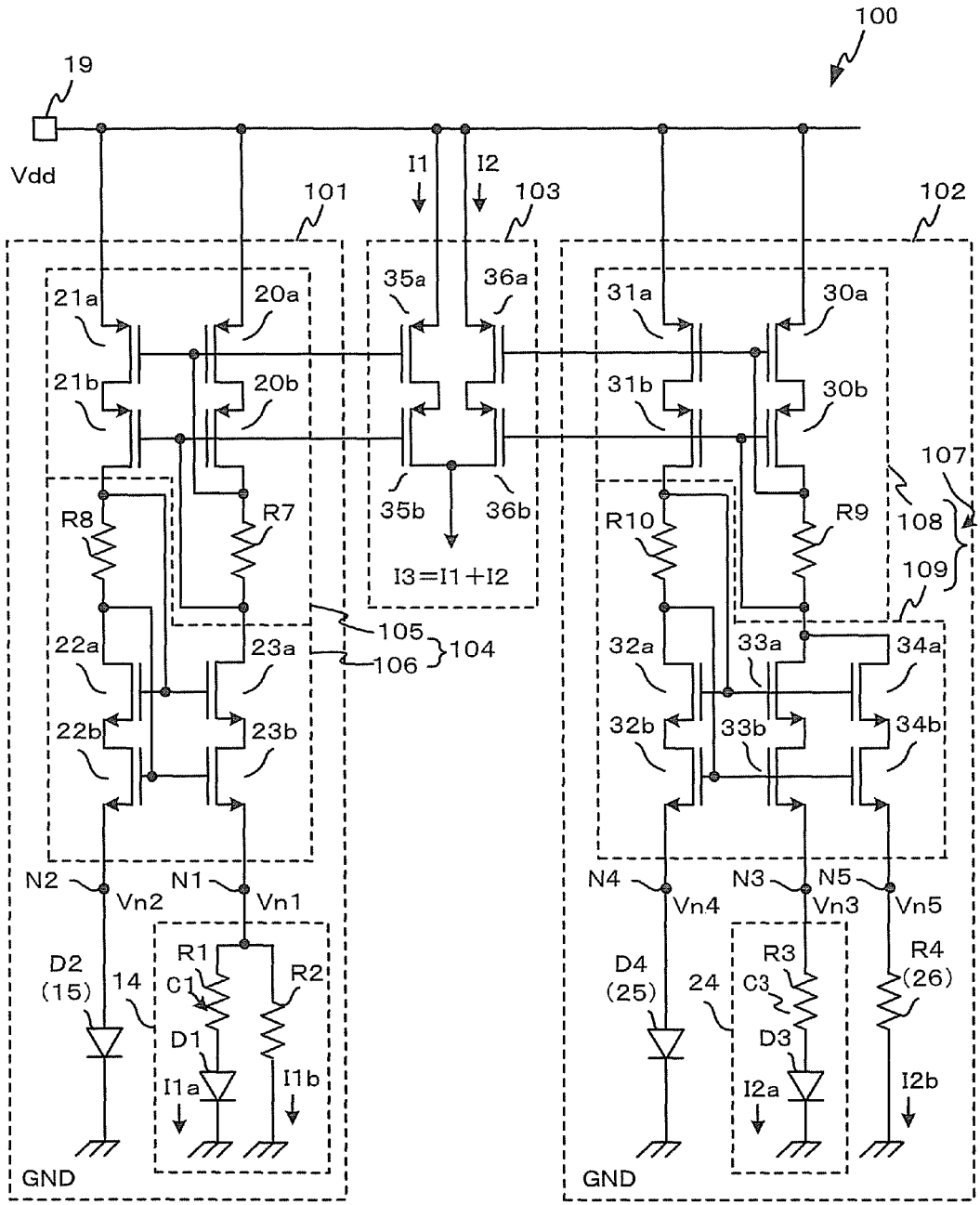
FIG. 11 is a circuit diagram illustrating a reference current generation circuit according to a fourth embodiment.

A reference current generation circuit according to a fourth embodiment will be described with reference to FIG. 11. FIG. 11 is a circuit diagram illustrating the reference current generation circuit according to the fourth embodiment.

As shown in FIG. 11, a reference current generation circuit 100 according to the embodiment is provided with a first reference current generation circuit 101 and a second reference current generation circuit 102, and a current output circuit 103.

In the first reference current generation circuit 101, a first current supply circuit 104 has a series circuit including a first cascode circuit 105 and a second cascode circuit 106, which are arranged on upper and lower sides respectively and are enclosed by dotted lines in FIG. 11.

The first cascode circuit 105 is provided with two first current mirror circuits similar to the circuit 17 of FIG. 1. The two first current mirror circuits are cascode-connected to each other. The second cascode circuit 106 is provided with two second current mirror circuits similar to the circuit 18 of FIG. 1. The two second current mirror circuits are cascode-connected to each other.

In the first cascode circuit 105, the gate of a PMOS transistor 20*a* connected to the power supply terminal 19 is connected to the drain of a cascode-connected PMOS transistor 20*b*. The gate of the PMOS transistor 20*b* is connected to the drain of the PMOS transistor 20*b* via a resistor R7. The drain of the PMOS transistor 20*b* is connected to the drain of an NMOS transistor 23*a* of the second cascode circuit 106 via the resistor R7.

In the second cascode circuit 106, the gate of an NMOS transistor 22*b* connected to a second node N2 is connected to the drain of a cascode-connected NMOS transistor 22*a* to the NMOS transistor 22*b*. The gate of the NMOS transistor 22*a* is connected to the drain via a resistor R8. The NMOS transistor 22*b* is connected to the drain of a PMOS transistor 21*b* of the first cascode circuit 105 via the resistor R8.

The resistors R7, R8 are provided to give bias voltages to the first cascode circuit 105 and the second cascode circuit 106, respectively.

In the second reference current generation circuit 102, a second current supply circuit 107 has a series circuit including a third cascode circuit 108 and a fourth cascode circuit 109, which are arranged on upper and lower sides respectively and are enclosed by dotted lines in FIG. 11. The third cascode circuit 108 is provided with two third current mirror circuits similar to the circuit 27 of FIG. 1. The third cascode circuit 108 includes cascade-connected PMOS transistors 30*a*, 30*b*, and cascade-connected PMOS transistors 31*a*, 31*b*. The two third current mirror circuits 27 are cascode-connected to each other. The fourth cascode circuit 109 is provided with two fourth current mirror circuits similar to the circuit 28 of FIG. 1. The fourth cascode circuit 109 includes cascade-connected NMOS transistors 32*a*, 32*b*, cascade-connected NMOS transistors, 33*a*, 33*b*, and cascade-connected NMOS transistors 34*a*, 34*b*. The two fourth current mirror circuits 28 are cascode-connected to each other.

A resistor R9 is connected between the PMOS transistor 30*b* and the NMOS transistors 33*a*, 34*a*. A resistor R10 is connected between the PMOS transistor 31*b* and the NMOS transistors 32*a*.

The third and fourth cascode circuits 108, 109 are connected in the same manner as the first and second cascode circuits 105, 106.

In the current output circuit 103, a series circuit of PMOS transistors 35*a*, 35*b* and a series circuit of PMOS transistors 36*a*, 36*b* are connected in parallel, which correspond to the first and second cascode circuits 105, 108, respectively.

The gates of the PMOS transistors 35*a*, 35*b* are connected to the gates of the PMOS transistor 20*a*, 20*b* of the first cascode circuit 105, respectively. The gates of the PMOS transistors 36*a*, 36*b* are connected to the gates of the PMOS transistor 30*a*, 30*b* of the third cascode circuit 1058, respectively.

The first and second current supply circuits 104, 107 are provided with the current mirror circuits similar to the circuits 17, 18, 28 and 29 of FIG. 1 which are cascode-connected. Accordingly, the first and second current supply circuits 104, 107 are configured such that voltage-current characteristics are robust against a power supply voltage Vdd. This reduces temperature drift of an input current and an output current so that the current mirror ratios are obtained with higher accuracy.

In the reference current generation circuit 100 according to the embodiment, the first and second current supply circuits 104, 107 are formed by cascode-connecting the current mirror circuits so as to increase impedance, so that the voltage-current characteristics are robust against the power supply voltage Vdd.

As a result, the fourth embodiment has an advantage that the temperature drifts of the input current and the output current are reduced so that the mirror ratios can be obtained with higher accuracy.

Similar to the second embodiment shown in FIG. 7, a second diode D2 is connected in parallel with the fifth resistor R5 in the embodiment. Further, a series circuit having a sixth resistor R6 and an NMOS transistor 83 is connected to the drain of an NMOS transistor 32*a* of the fourth cascode circuit 109. The drain and gate of the NMOS transistor 83 are connected to each other The fourth embodiment as described above is configured such that the first to fourth current mirror circuits similar to the first to fourth current mirror circuits 17, 18, 28, 29 of FIG. 1 are cascode-connected. Alternatively, the first to fourth current mirror circuits may be partially cascode-connected.

In the first current supply circuit 104, one or both of the first and second current mirror circuits similar to the first and second current mirror circuits 17, 18 of FIG. 1 may be cascode-connected. In the second current supply circuit 107, one or both of the third and fourth current mirror circuits similar to the third and fourth current mirror circuits 28, 29 of FIG. 1 may be cascode-connected. In this manner, current mirror circuits to be cascode-connected are not especially limited, and may be selected as necessary.

FIGS. 12 to 17 are circuit diagrams illustrating modifications of the reference current generation circuit according to the fourth embodiment of FIG. 11. In the modifications, current mirror circuits are partially cascode-connected.

Figure 12:
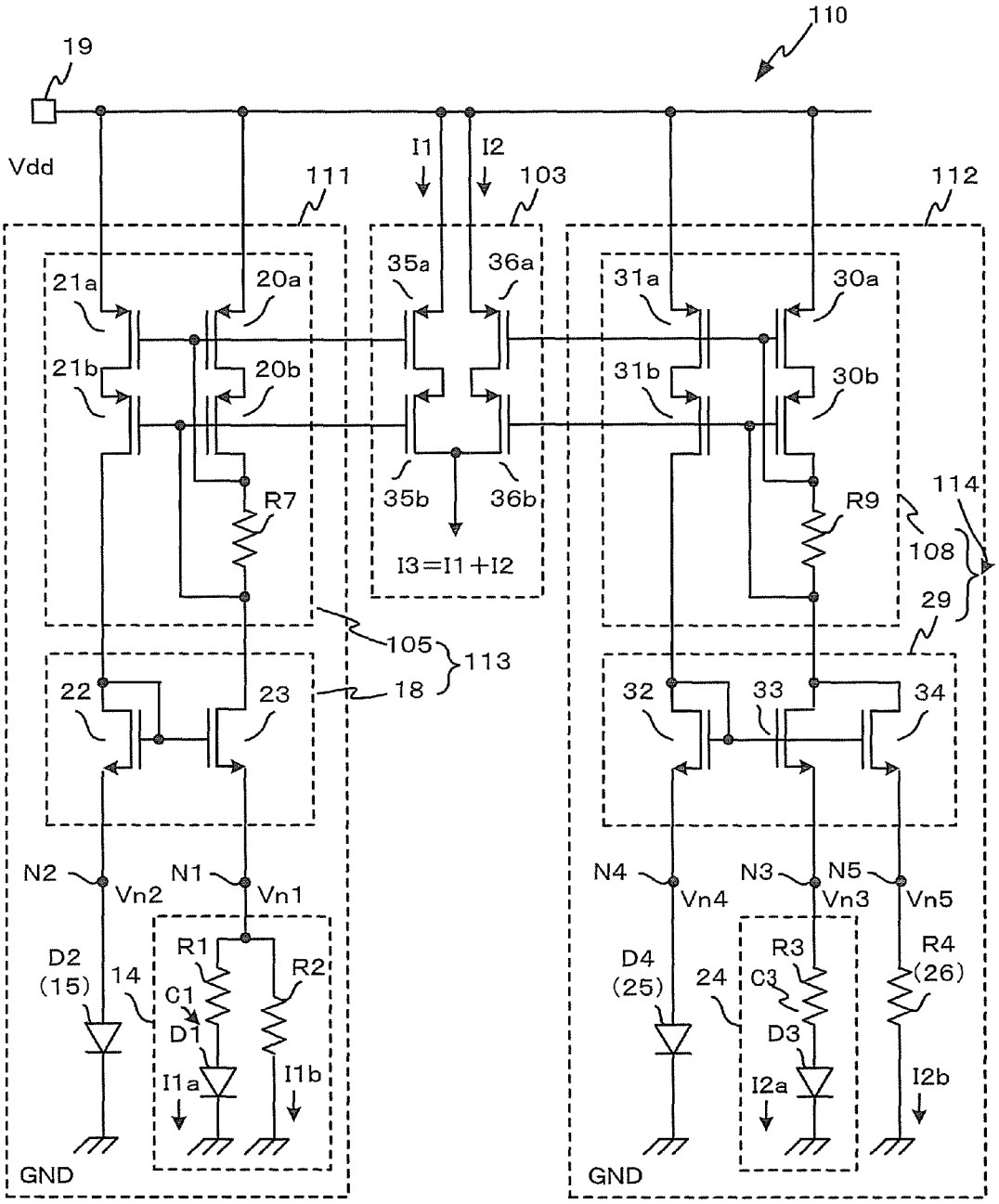
FIG. 12 is a circuit diagram illustrating a modification of the reference current generation circuit according to the fourth embodiment.

For example, a reference current generation circuit 110 of FIG. 12 is a circuit similar to the reference current generation circuit 100 of FIG. 11, except that the second current mirror circuit 106 of FIG. 11 is replaced with the second current mirror circuit 18 shown in FIG. 1, and that the fourth current mirror circuit 109 of FIG. 11 is replaced with the fourth current mirror circuit 109 shown in FIG. 1.

Figure 13:
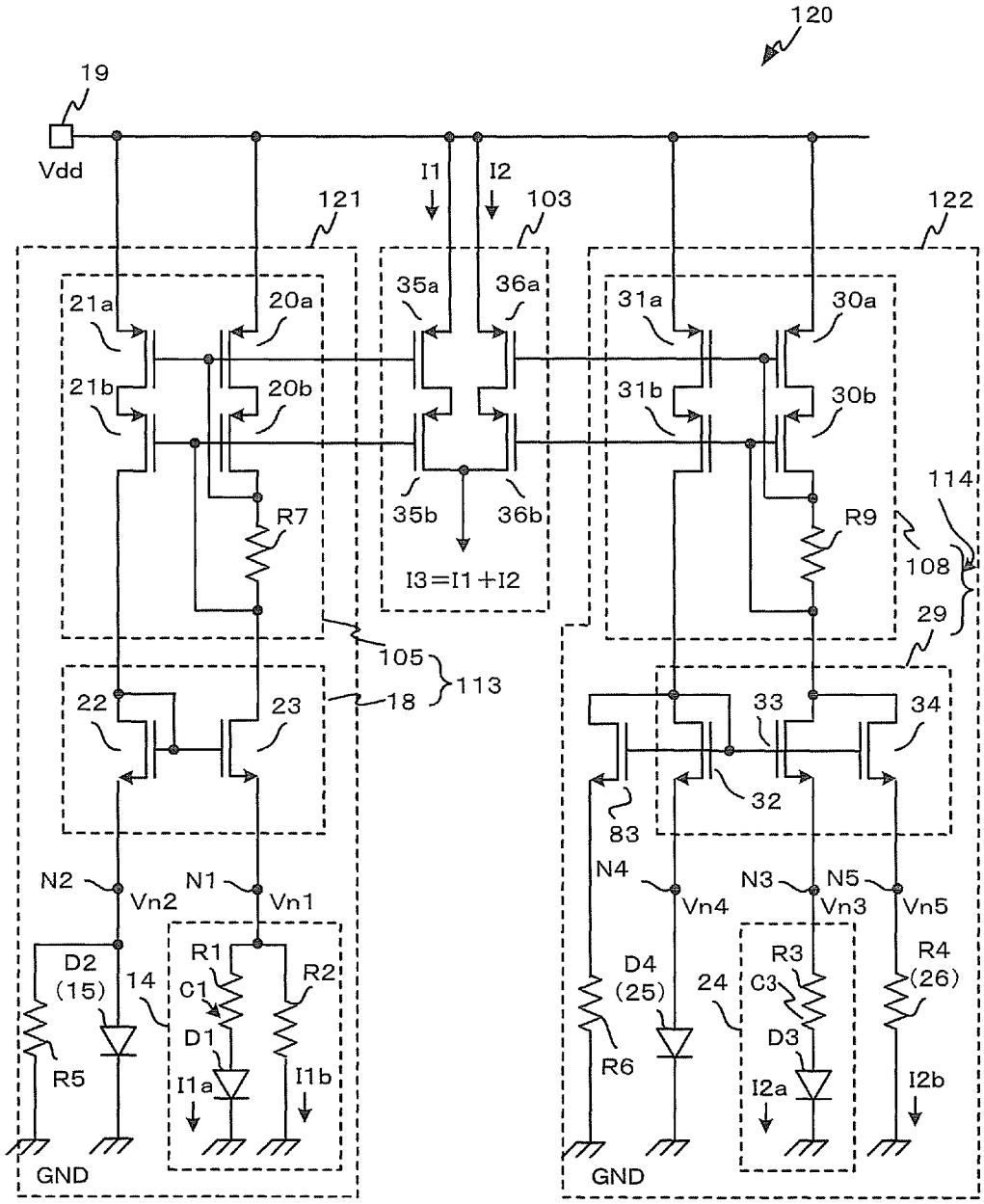
FIG. 13 is a circuit diagram illustrating another modification of the reference current generation circuit according to the fourth embodiment.

A reference current generation circuit 120 of FIG. 13 is a circuit similar to the reference current generation circuit 110 of FIG. 12, except that a fifth resistor R5 and a series circuit which has a sixth resistor R6 and an NMOS transistor 83 are provided additionally, as the second embodiment of FIG. 7. The drain and gate of the NMOS transistor 83 are connected to each other.

Figure 14:
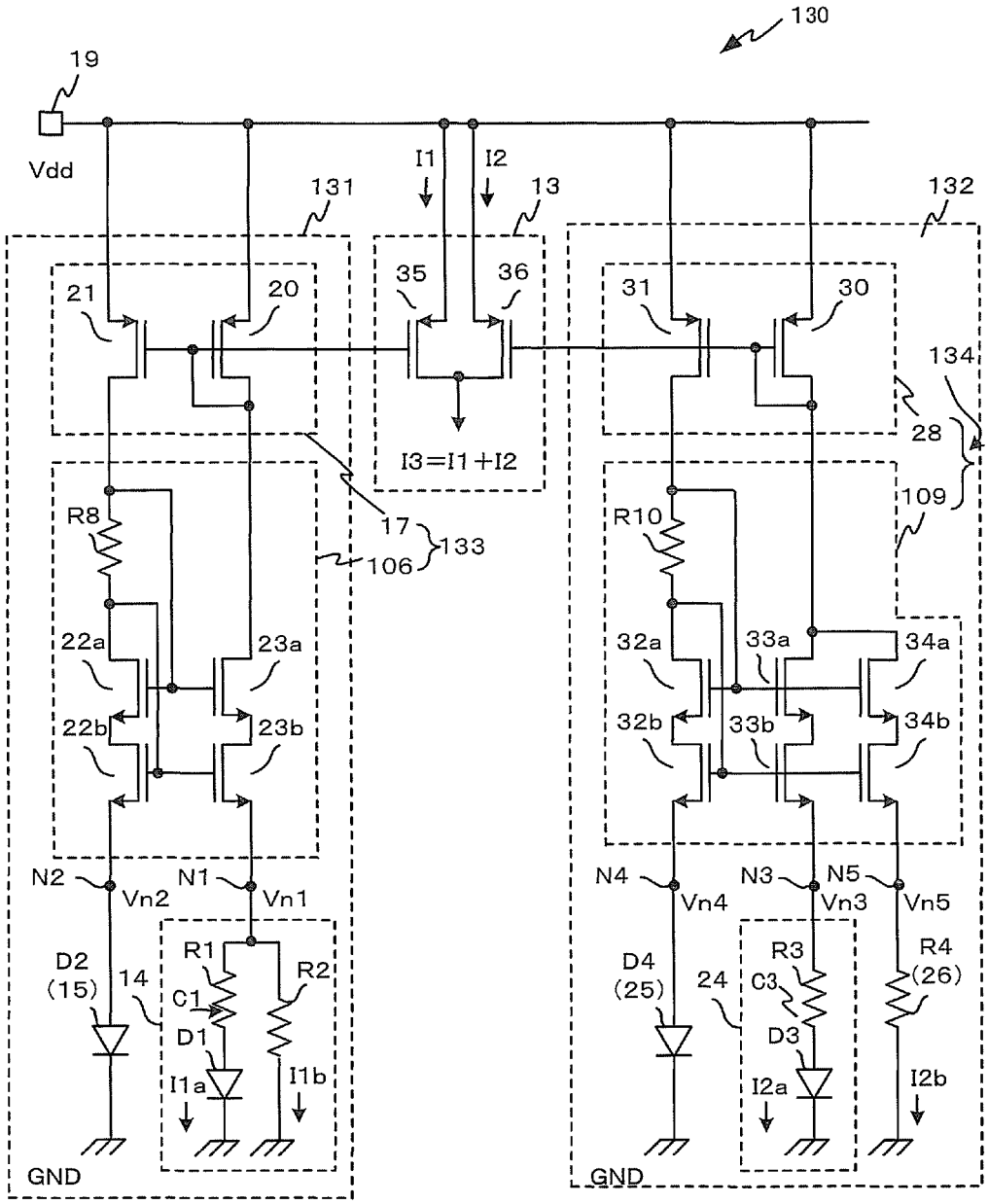
FIG. 14 is a circuit diagram illustrating still another modification of the reference current generation circuit according to the fourth embodiment.

A reference current generation circuit 130 of FIG. 14 is a circuit similar to the reference current generation circuit 100 of FIG. 11, except that the first and fourth current mirror circuits 105, 108 of FIG. 11 are replaced with the first and fourth current mirror circuits 17, 28 shown in FIG. 1, and that the current output circuit 103 of FIG. 11 is replaced with the current output circuit 13 shown in FIG. 1.

Figure 15:
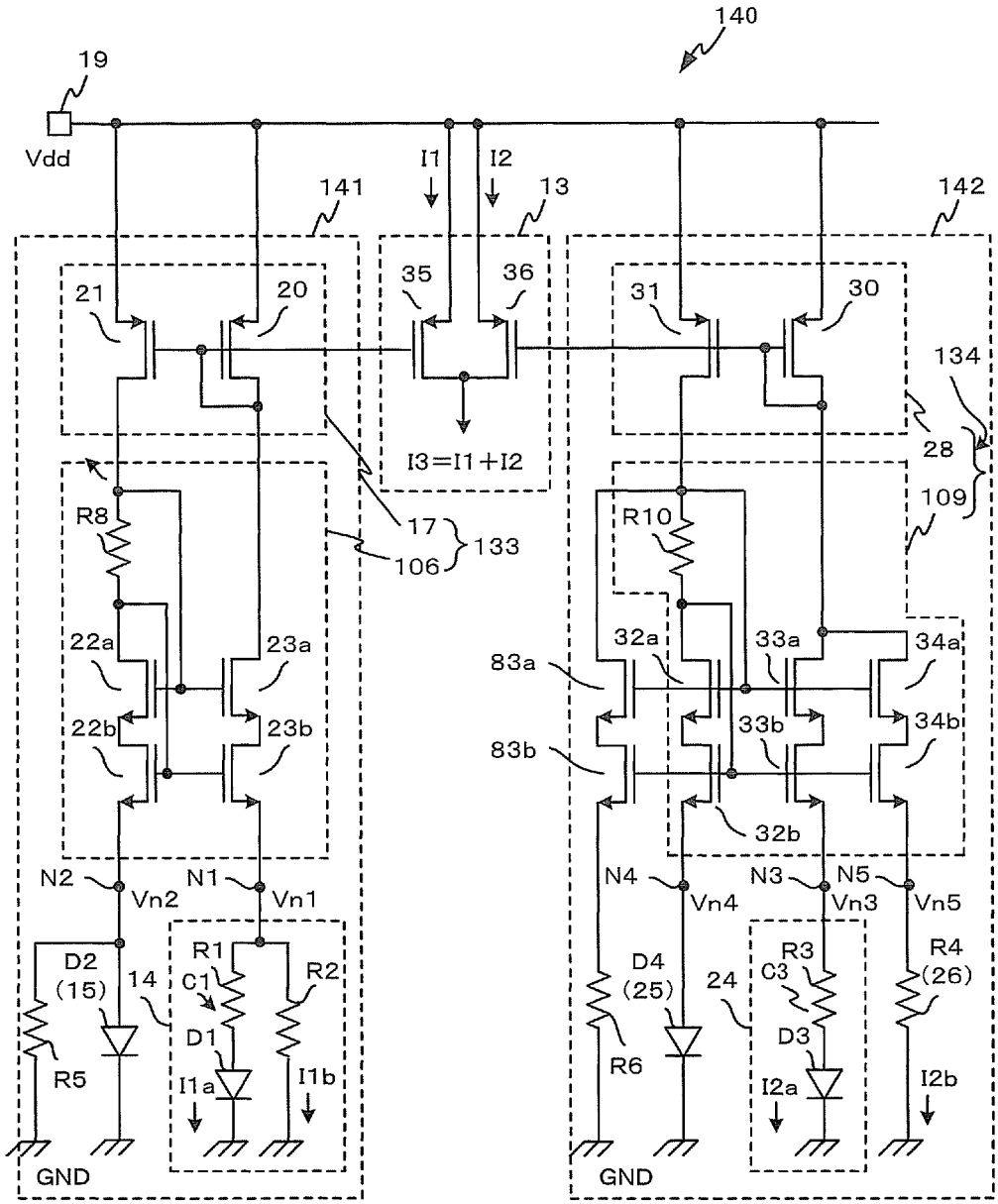
FIG. 15 is a circuit diagram illustrating still another modification of the reference current generation circuit according to the fourth embodiment.

A reference current generation circuit 140 of FIG. 15 is a circuit similar to the reference current generation circuit 130 of FIG. 14, except that a fifth resistor R5 and a series circuit which has a sixth resistor R6 and NMOS transistors 83*a*, 83*b* are provided additionally similarly to the second embodiment of FIG. 7. The drain and gate of the NMOS transistor 83*a* are connected to each other. The drain of the NMOS transistor 83*a* is connected to the drain of the PMOS transistor 31.

Figure 16:
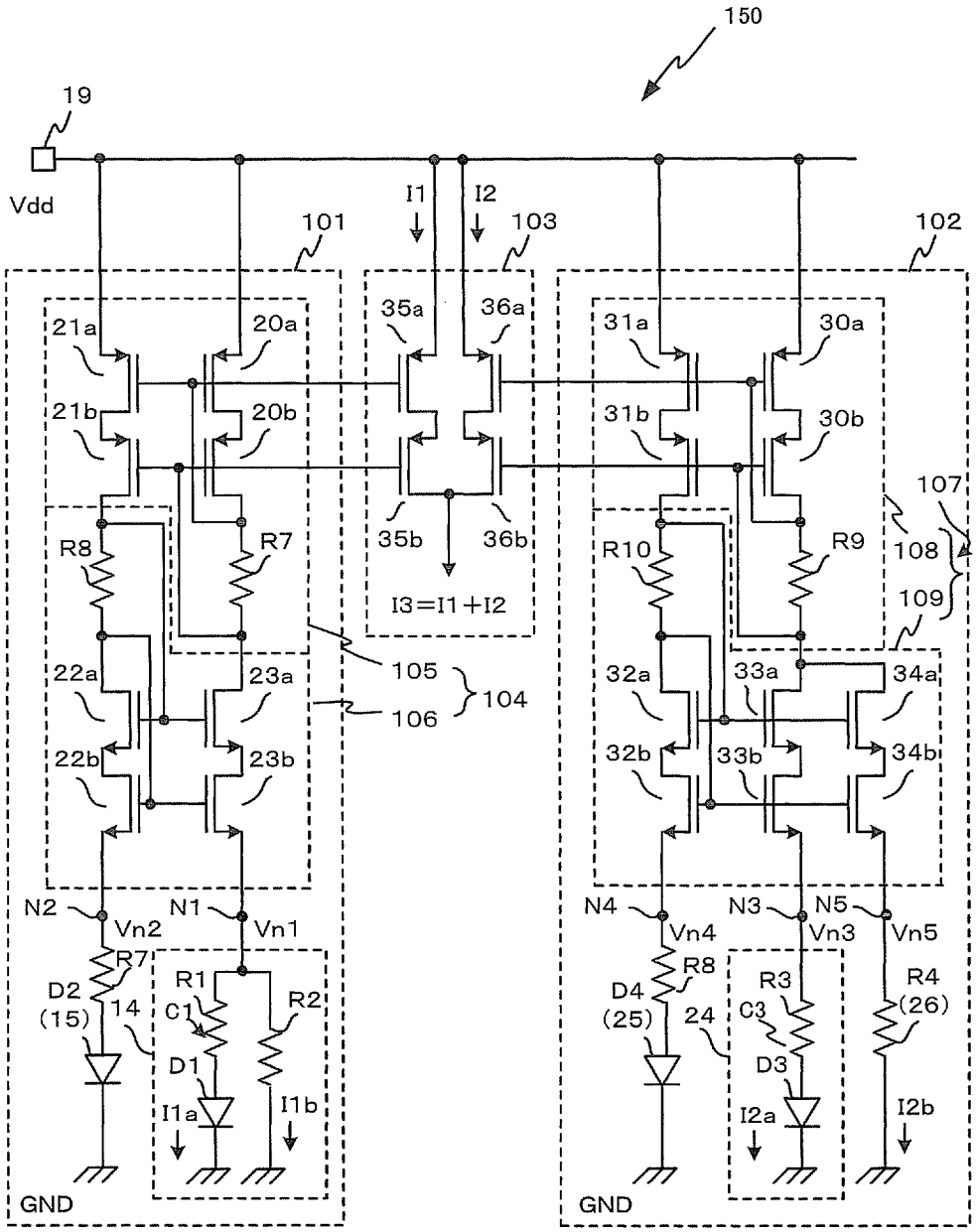
FIG. 16 is a circuit diagram illustrating still another modification of the reference current generation circuit according to the fourth embodiment.

A reference current generation circuit 150 of FIG. 16 has a structure similar to the reference current generation circuit 100 of FIG. 11, except that a resistor R7 is additionally connected to the diode D2 in series between the node N2 and the reference potential GND, i.e., a ground potential, and that resistor R8 is additionally connected to the diode D4 in series between the node N4 and the reference potential GND, i.e., the ground potential. This configuration enables changing the temperature characteristic of the reference current generation circuit 150 from PTAT to CONST or NTAT.

Figure 17:
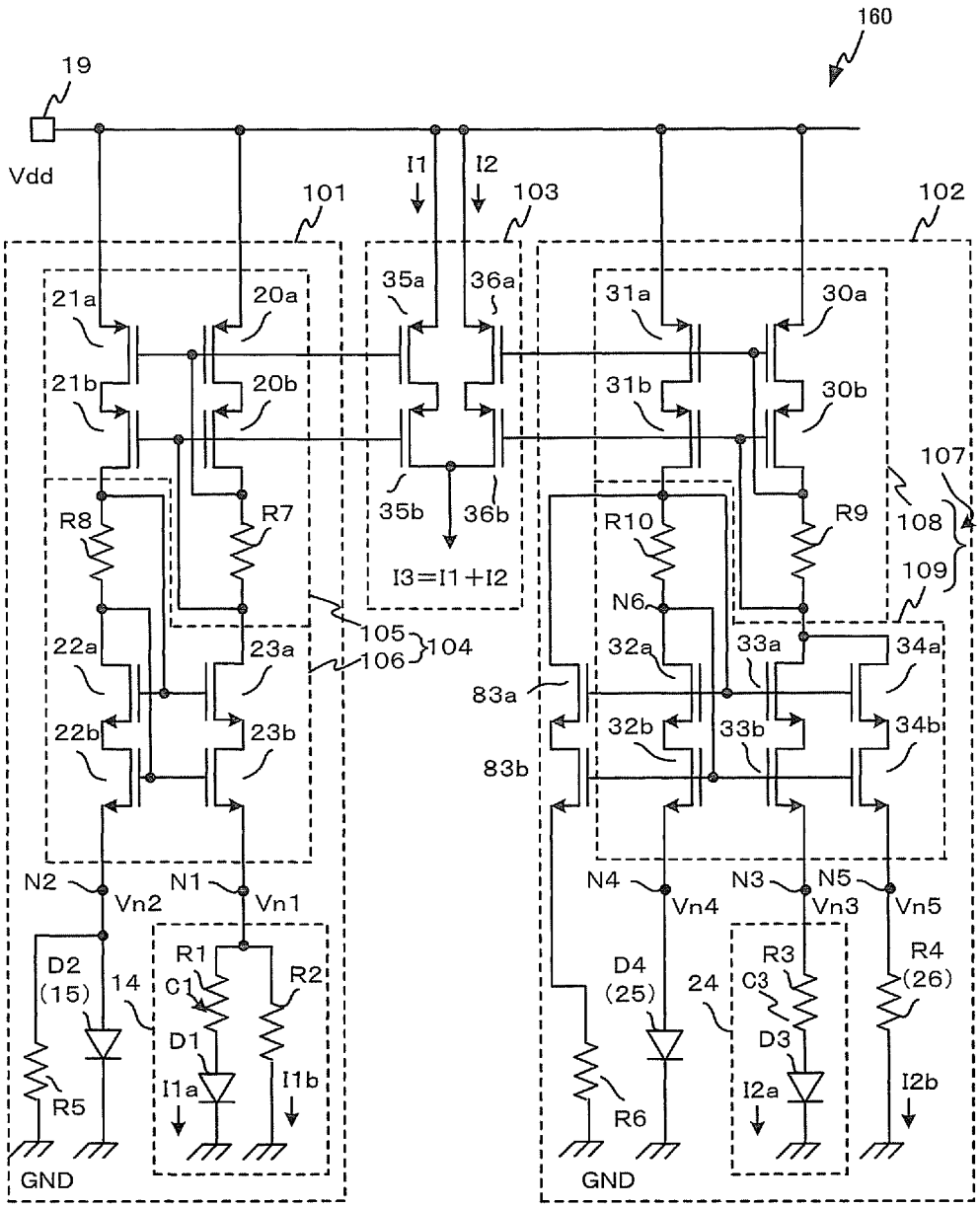
FIG. 17 is a circuit diagram illustrating still another modification of the reference current generation circuit according to the fourth embodiment.

A reference current generation circuit 160 of FIG. 17 has a structure similar to the reference current generation circuit 100 of FIG. 11, except that a resistor R5 is additionally connected between the node N2 and the reference potential GND, i.e., a ground potential, and that cascade-connected NMOS transistors, 83*a*, 83*b* and a resistor R6 is additionally connected in series between the node N6 and the reference potential GND. The modification may have the advantages of the fourth embodiment of FIG. 7 as well as the advantages of the second embodiment of FIG. 7.

In the above modifications, bias voltage for cascode-connecting can be generated by providing the resistors R7 to R10, as the fourth embodiment of FIG. 11. In the above modifications, an effect of increase of impedance caused by the cascode connection can be obtained as the fourth embodiment of FIG. 11.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reference current generation circuit, comprising first and second reference current generation circuits for generating first and second reference currents, respectively, and a current output circuit for outputting a third reference current by adding the first and second reference currents, the first reference current generation circuit including:

a first current-voltage conversion circuit provided with a first series circuit having a first resistor and a first diode, and a second resistor connected in parallel with the first series circuit;

a second current-voltage conversion circuit having a second diode; and a first current supply circuit to provide a substantially equal amount of current to the first and second current-voltage conversion circuits respectively, the second reference current generation circuit including:

a third current-voltage conversion circuit provided with a second series circuit having a third resistor and a third diode;

a fourth current-voltage conversion circuit having a fourth diode;

a fifth current-voltage conversion circuit having a fourth resistor; and a second current supply circuit to provide a current to the fourth current-voltage conversion circuit, and to divide and provide an amount of current substantially equal to that of the current provided to the fourth current-voltage conversion circuit, to the third and fifth current-voltage conversion circuits respectively.

2. The circuit according to claim 1, wherein the first reference current has a negative second-order temperature coefficient, and the second reference current has a positive second-order temperature coefficient, the absolute value of the positive second-order temperature coefficient being substantially equal to that of the negative second-order temperature coefficient.

3. The circuit according to claim 1, further comprising a resistor connected between the second diode and the first current supply circuit and a resistor connected between the fourth diode and the second current supply circuit.

4. The circuit according to claim 1, wherein the first current supply circuit is provided with a first current mirror circuit and a second current minor circuit connected in series to the first current minor circuit, the first current minor circuit being provided with first insulated-gate field effect transistors of a first conduction channel, the second current mirror circuit being provided with second insulated-gate field effect transistors of a second conduction channel connected to the first and second current-voltage conversion circuits, the second current supply circuit being provided with a third current mirror circuit and a fourth current mirror circuit connected in series to the third current mirror circuit, the third current minor circuit being provided with third insulated-gate field effect transistors of the first conduction channel, the fourth current minor circuit being a multiple output type and being provided with three fourth insulated-gate field effect transistors of the second conduction channel connected to third to fifth current-voltage conversion circuits, respectively, and wherein the current output circuit is provided with a parallel circuit having fifth and sixth insulated-gate field effect transistors of the first conduction channel, the fifth insulated-gate field effect transistor being additionally connected to the first current minor circuit and forming a multiple output type current minor circuit, the sixth insulated-gate field effect transistor being additionally connected to the third current mirror circuit and forming a multiple output type current mirror circuit.

5. The circuit according to claim 4, further comprising seventh insulated-gate field effect transistors of the first conduction channel and/or the second conduction channel and eighth insulated-gate field effect transistors of the first conduction channel and/or the second conduction channels, wherein the seventh insulated-gate field effect transistors of the first conduction channel and/or the second conduction channel are cascode-connected to the first current minor circuit and/or the second current mirror circuit, and the eighth insulated-gate field effect transistors of the first conduction channel and/or the second conduction channel are cascode-connected to the third current minor circuit and/or the fourth current mirror circuit.

6. The circuit according to claim 5, further comprising a resistor connected between the second diode and the first current supply circuit and a resistor connected between the fourth diode and the second current supply circuit.

7. The circuit according to claim 1, further comprising a fifth resistor and a third series circuit having a sixth resistor and a seventh insulated-gate field effect transistor of the second conduction channel, the drain and gate of the seventh insulated-gate field effect transistor being connected to each other, wherein the fifth resistor is connected in parallel with the second diode, and the third series circuit is connected to a current input node of the fourth current mirror circuit.

8. The circuit according to claim 7, wherein the first reference current has a negative second-order temperature coefficient, and the second reference current has a positive second-order temperature coefficient, the absolute value of the positive second-order temperature coefficient being substantially equal to that of the negative second-order temperature coefficient.

9. The circuit according to claim 7, wherein the first current supply circuit is provided with a first current mirror circuit and a second current minor circuit connected in series to the first current minor circuit, the first current mirror circuit being provided with first insulated-gate field effect transistors of a first conduction channel, the second current mirror circuit being provided with second insulated-gate field effect transistors of a second conduction channel connected to the first and second current-voltage conversion circuits, the second current supply circuit being provided with a third current mirror circuit and a fourth current mirror circuit connected in series to the third current mirror circuit, the third current minor circuit being provided with third insulated-gate field effect transistors of the first conduction channel, the fourth current minor circuit being a multiple output type and being provided with three fourth insulated-gate field effect transistors of the second conduction channel connected to third to fifth current-voltage conversion circuits, respectively, and wherein the current output circuit is provided with a parallel circuit having fifth and sixth insulated-gate field effect transistors of the first conduction channel, the fifth insulated-gate field effect transistor being additionally connected to the first current minor circuit and forming a multiple output type current minor circuit, the sixth insulated-gate field effect transistor being additionally connected to the third current mirror circuit and forming a multiple output type current mirror circuit.

10. The circuit according to claim 9, further comprising seventh insulated-gate field effect transistors of the first conduction channel and/or the second conduction channel and eighth insulated-gate field effect transistors of the first conduction channel and/or the second conduction channels, wherein the seventh insulated-gate field effect transistors of the first conduction channel and/or the second conduction channel are cascode-connected to the first current minor circuit and/or the second current mirror circuit, and the eighth insulated-gate field effect transistors of the first conduction channel and/or the second conduction channel are cascode-connected to the third current minor circuit and/or the fourth current mirror circuit.

11. A reference current generation circuit, comprising a second reference current generation circuit for generating a second reference current, and a fourth series circuit, the fourth series circuit having a ninth insulated-gate field effect transistor of a first conduction channel and a load indicating a negative second-order temperature coefficient, the second reference current generation circuit including:

a third current-voltage conversion circuit provided with a second series circuit having a third resistor and a third diode;

a fourth current-voltage conversion circuit having a fourth diode;

a fifth current-voltage conversion circuit having a fourth resistor; and a second current supply circuit for providing a current to the fourth current-voltage conversion circuit, for providing an amount of current substantially equal to that of the current provided to the fourth current-voltage conversion circuit, to the fourth series circuit, and for dividing and providing an amount of current substantially equal to that of the current provided to the fourth current-voltage conversion circuit, to the third and fifth current-voltage conversion circuits respectively, the second current supply circuit being provided with a third current mirror circuit and a fourth current mirror circuit connected in series to the third current mirror circuit, the third current minor circuit being provided with third insulated-gate field effect transistors of the first conduction channel, and the fourth current minor circuit being a multiple output type and being provided with three fourth insulated-gate field effect transistors of the second conduction channel connected to third to fifth current-voltage conversion circuits, respectively.

12. The circuit according to claim 11, wherein the second reference current has a positive second-order temperature coefficient, the absolute value of the positive second-order temperature coefficient being substantially equal to that of the negative second-order temperature coefficient.

13. The circuit according to claim 11, wherein the second current supply circuit being provided with a third current mirror circuit and a fourth current mirror circuit connected in series to the third current mirror circuit, the third current minor circuit being provided with third insulated-gate field effect transistors of the first conduction channel, the fourth current minor circuit being a multiple output type and being provided with three fourth insulated-gate field effect transistors of the second conduction channel connected to third to fifth current-voltage conversion circuits, respectively.

14. A reference current generation circuit, comprising:

a third current-voltage conversion circuit provided with a second series circuit having a third resistor and a third diode;

a fourth current-voltage conversion circuit having a fourth diode;

a fifth current-voltage conversion circuit having a fourth resistor;

a second current supply circuit for providing a current to the fourth current-voltage conversion circuit, and for dividing and providing an amount of current substantially equal to that of the current provided to the fourth current-voltage conversion circuit, to the third and fifth current-voltage conversion circuits respectively, wherein a reference current has a positive second-order temperature coefficient is produced; and a resistor connected between the second diode and the first current supply circuit and a resistor connected between the fourth diode and the second current supply circuit;

the second current supply circuit being provided with a third current mirror circuit and a fourth current mirror circuit connected in series to the third current mirror circuit, the third current minor circuit being provided with third insulated-gate field effect transistors of the first conduction channel, the fourth current minor circuit being a multiple output type and being provided with three fourth insulated-gate field effect transistors of the second conduction channel connected to third to fifth current-voltage conversion circuits, respectively.

15. The circuit according to claim 14, further comprising eighth insulated-gate field effect transistors of the first conduction channel and/or the second conduction channels, wherein the eighth insulated-gate field effect transistors of the first conduction channel and/or the second conduction channel are cascode-connected to the third current minor circuit and/or the fourth current mirror circuit.

16. The circuit according to claim 15, further comprising a resistor connected between the second diode and the first current supply circuit and a resistor connected between the fourth diode and the second current supply circuit.

* * * * *